US005970872A

United States Patent [19]

Iwamoto et al.

[11] Patent Number: 5,970,872

[45] Date of Patent: Oct. 26, 1999

[54] FIXING APPARATUS FOR A WET-TYPE PLATE MAKING MACHINE

[75] Inventors: Tamio Iwamoto; Seiji Matsuo; Masahiro Hayashi, all of Tokyo, Japan

[73] Assignee: Iwatsu Electric Co., Ltd., Tokyo, Japan

[21] Appl. No.: 09/039,396

[22] Filed: Mar. 16, 1998

[30] Foreign Application Priority Data

Mar. 14, 1997 [JP] Japan ..... 9-082074
Oct. 6, 1997 [JP] Japan ..... 9-289046

[51] Int. Cl.[6] ..... B41F 35/00

[52] U.S. Cl. ..... 101/423; 101/425

[58] Field of Search ..... 101/423, 424, 101/425; 399/320, 326, 327, 343, 352

[56] References Cited

U.S. PATENT DOCUMENTS

| | | | |
|---|---|---|---|
| 4,389,936 | 6/1983 | Jaffa et al. | 101/123 |
| 4,939,552 | 7/1990 | Nakanishi | 355/300 |
| 5,335,047 | 8/1994 | Kai et al. | 355/200 |
| 5,485,781 | 1/1996 | Rovaris | 101/425 |
| 5,534,985 | 7/1996 | Rosso et al. | 355/283 |
| 5,749,038 | 5/1998 | Fromm et al. | 399/327 |

*Primary Examiner*—Edgar Burr
*Assistant Examiner*—Anthony H. Nguyen
*Attorney, Agent, or Firm*—Oblon, Spivak, McClelland, Maier & Neustadt, P.C.

[57] ABSTRACT

A fixing apparatus for a wet-type plate making machine, which includes panel heaters 13 and 14 for fixation and drying of an electrostatic latent image an a front surface of a master X after development with developing solution and a cleaning web 20 that is laid over top surfaces of the aforenamed panel heaters 13 and 14 and that will be wound around a web take-up bobbin 20B that is disposed at an end of the same panel heater 14, and which also includes a web take-up shaft 27 that has a bobbin attachment and 27*a* for supporting of the aforenamed web take-up bobbin 20B and a manual operation end 27*b* that can be turned freely with finger tips, a first one way clutch 31 that is fitted on the take-up shaft 27 and that transmits revolving movements of a clutch sleeve 31*a* that is reciprocally revolved by a solenoid 29 at the apparatus securing part but transmits only those in one direction to the aforenamed take-up shaft 27, and a second one way clutch 36 that in fitted on the take-up shaft 27 and that allows forced revolving movements of the aforenamed take-up shaft 27 in a taking-up direction by the aforenamed manual operation end 27*b*.

7 Claims, 10 Drawing Sheets

FIXING APPARATUS FOR A WET-TYPE PLATE MAKING MACHINE

BACKGROUND OF THE INVENTION

1. Field of the Invention

The present invention relates to a wet-type plate making machine and specifically to a fixing apparatus of the wet-type plate making machine.

2. Description of the Related Art

There has been generally known that a wet-type plate making machine wherein an electrostatic latent image on a front surface of a master is developed with developing solution develops the electrostatic latent image at a developing apparatus and then, after removing and cleaning a photosensitive stratum at a rinsing-squeezing apparatus, fixes and dries a toner image with a fixing apparatus.

FIG. 1 shows a fixing apparatus of the above type for the wet-type plate making machine, wherein a preheating panel heater B and a drying panel heater C which are aligned in a conveyance direction of a master X are disposed on a fixing apparatus frame A is disposed and, while the master X that is delivered from a rinsing-squeezing apparatus that is not shown in the figure is being conveyed by intermediate conveyance rollers D and exit conveyance rollers E, a toner image on a front surface thereof is fixed and dried. FIG. 1 also shows retaining rollers F for having the master X be in tight contact with the top surface of the drying panel heater, and electric heaters G.

In the fixing apparatus of the structure as described above, the master X which contains a lot of moisture in delivered from the rinsing-squeezing apparatus and especially the rear surface of the master X is wet with drops of liquid which contains surplus toner and residue of the photosensitive stratum.

Therefore, at the time of preheating and drying by the preheating panel heater B and the drying panel heater, the surplus toner and photo sensitive stratum residue are transferred to the top surfaces b and c of the preheating panel heater B and drying panel heater C and grow into manses. Eventually, a front edge of the master may collide against the masses sticking to the top surfaces b and c of the preheating panel heater B and the drying panel heater C to cause a jam or the masses may separated abruptly from the top surfaces b and c of the preheating panel heater B and the drying panel heater C to contaminate the toner image on the front surface of the master X.

Another problem with the conventional fixing apparatus is that the surplus toner on the rear surface of the master X has been dried as it was and the surplus toner on the rear surface of the finished master X can contaminate operator's hands.

SUMMARY OF THE INVENTION

The present invention has been made to solve the above-mentioned problems with the conventional fixing apparatus for use in the wet-type plate making machine, and therefore an object of the present invention is to provide a fixing apparatus for a wet-type plate making machine wherein top surfaces of the panel heaters will not be contaminated by such as surplus toner, jams during conveyance of the master being successfully prevented and toner waste being prevented from contaminating the front surface of the master.

Another object of the present invention is to provide a fixing apparatus for a wet-type plate making machine which allows an inexperienced operator to met a new cleaning web in a tense state without slacking.

Still another object of the present invention is to provide a fixing apparatus for a wet-type plate making machine which is capable of realizing an intermittent feeding of a uniform amount of the cleaning web, irrelevant to a diameter of the taken-up cleaning web.

In order to solve the above object, according to the present invention, there is provided a fixing apparatus for a wet-type plate making machine, which comprises a heater unit for fixation and drying after development of an electrostatic latent image on a front surface of a master with developing solution, wherein a cleaning web that is intermittently fed in a direction opposite to a conveyance direction of the aforenamed master is laid over top surfaces of the aforenamed panel heater unit so that surplus solution on a rear surface of the aforenamed master is adsorbed by the same cleaning web.

In particular, according to the present invention, there is provided a fixing apparatus for a wet-type plate making machine, which comprises a panel heater unit that fixes and dries an electrostatic latent image on a front surface of a master after development with developing solution and a cleaning web that is laid over top surfaces of the aforenamed panel heater unit and that will be wound around a web take-up bobbin that is disposed at an end of the same panel heater unit, and which characteristically comprises a web take-up shaft that has a bobbin attachment and for supporting of the aforenamed web take-up bobbin and a manual operation and that can be turned freely with finger tips, a first one way clutch that is fitted on the take-up shaft and that transmits revolving movements of a clutch sleeve that is reciprocally revolved by a solenoid at the apparatus securing part but transmits only those in one direction to the aforenamed take-up shaft, and a second one way clutch that is fitted on the take-up shaft and that allows forced revolving movements of the aforenamed take-up shaft in a taking-up direction by the aforenamed manual operation end.

The aforenamed panel heater unit is comprised of a preheating panel heater and a drying panel heater which adjoin each other and wherein the aforenamed cleaning web is maintained in a tense state while covering entire top surfaces of the aforenamed preheating panel heater and drying panel heater via a relay roller between the preheating panel heater and the drying panel heater and is also unwound off a web delivery bobbin which is disposed on an outlet side of the aforenamed drying panel heater and wound around a web take-up bobbin which is disposed on an inlet side of the aforenamed preheating panel heater.

Further, according to the present invention, there is provided a fixing apparatus for a wet-type plate making machine, which comprises a preheating panel heater and a drying panel heater that adjoin each other and a cleaning web which is maintained in a tense state while covering entire top surfaces of the aforenamed preheating panel heater and drying panel heater via a relay roller between the preheating panel heater and the drying panel heater and which is also unwound off a web delivery bobbin which is disposed on an outlet side of the aforenamed drying panel heater and wound around a web take-up bobbin that is disposed on an inlet side of the aforenamed preheating panel heater, and which comprises a web take-up shaft that has a bobbin attachment end for supporting of the aforenamed web take-up bobbin and a manual operation end that can be turned freely with finger tips, a first one way clutch that is fitted on the take-up shaft and that transmits revolving movements of a clutch sleeve that is reciprocally revolved by a solenoid at the apparatus securing part but transmits only those in one direction to the aforenamed take-up shaft, a torque limiter that is installed between a bobbin holder which is provided at the aforenamed bobbin attachment end and the aforenamed web take-up bobbin and that prevents transmission of torques larger than a certain torque to the same bobbin, a timing belt that is stretched to connect between a driving sprocket of the aforenamed take-up shaft and a driven sprocket which rotates the aforenamed relay roller and that transmits intermittent progressive movements by the aforenamed solenoid to the same relay roller and a second one way clutch that is fitted on the take-up shaft and that allows forced revolving movements of the aforenamed take-up shaft in a taking-up direction by the aforenamed manual operation end.

Alternatively, according to the invention, the aforenamed panel heater unit is comprised of a preheating panel heater and a drying panel heater that adjoin each other, and wherein the aforenamed cleaning web is maintained in a tense state while covering entire top surfaces of the aforenamed preheating panel heater and drying panel heater and is also unwound off a web delivery bobbin which is disposed on an outlet side of the aforenamed drying panel heater and wound around a web take-up bobbin which is located on an inlet side of the aforenamed preheating panel heater so that an inching means will intermittently progress the aforenamed web take-up bobbin by uniform degrees of angle each time. Instead of the structure in which the inching means intermittently progresses the above cleanning web by uniform degrees of angle each time, the inching means intermittently progresses the aforenamed web take-up bobbin by uniform degrees of angle each time while a winding force is applied to the aforenamed web take-up bobbin via a slide mechanism.

DETAILED DESCRIPTION OF THE PREFERRED EMBODIMENTS

Now, a description will be given in more detail of preferred embodiments of the present invention with reference to the accompanying drawings.

Figure 1:
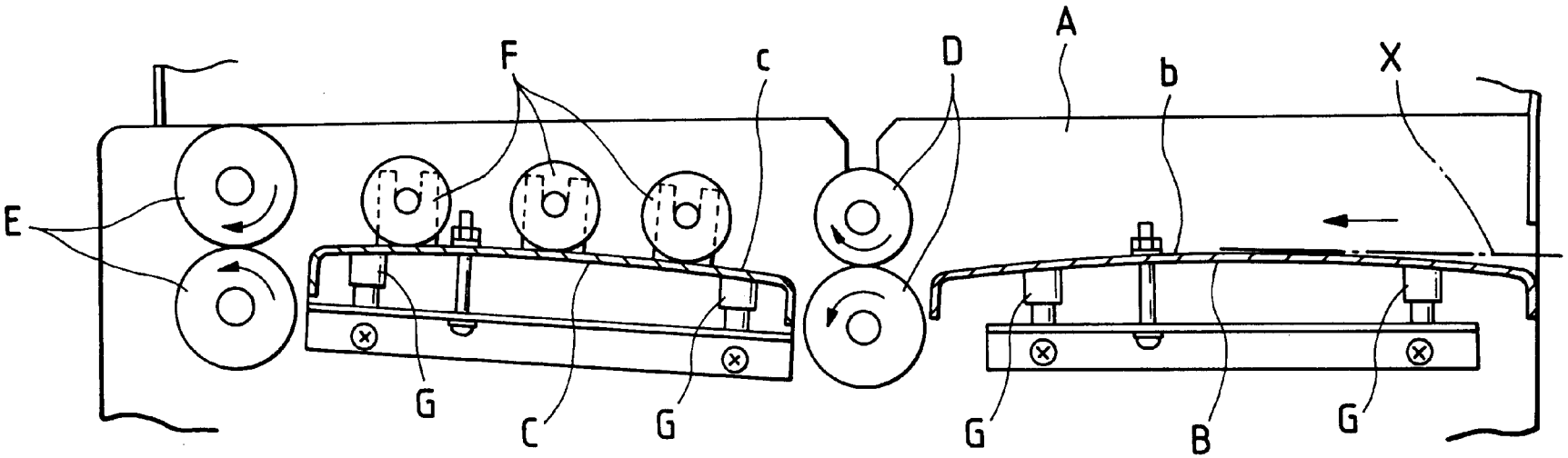
FIG. 1 PRIOR ART
FIG. 1 is a sectional view showing a conventional fixing apparatus.
Figure 2:
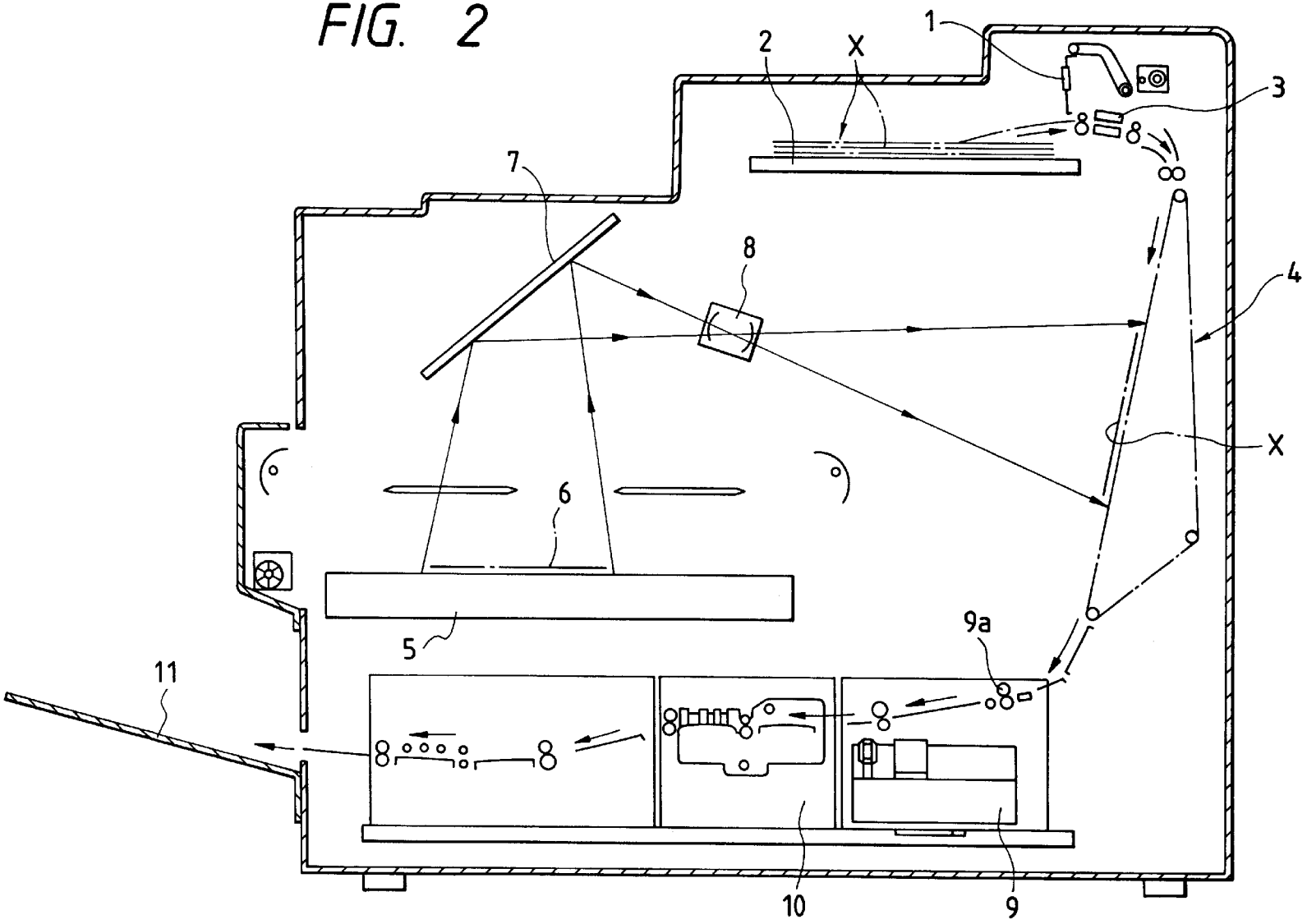
FIG. 2 is a sectional view showing a wet-type plate making machine as an application of the present invention.

FIGS. 2 to 5 show a first embodiment of the present invention and FIG. 2 shows a wet-type plate making machine with application of the present invention. As shown in FIG. 2, each master X is picked up one by one from a master stack table 2 with a vacuum suction head 1, passed through an electric charger 3, conveyed onto an exposure stage 4 and halted on the same exposure stage 4 whereat an original image is made into an electrostatic latent image with utilization of a mirror 7 which projects an optical image of an original 6 on an original table 5 and a photographing lens 8.

The master X with the electrostatic latent image undergoes a toner development by a developing apparatus 9 which is equipped with a developing solution sprayer 9*a* and then the master X with a manifested image is supplied to a rinsing-squeezing apparatus 10 so as to be removed of unexposed photosensitive stratum and rinsed and is conveyed to a fixing apparatus shown in FIG. 3 which is described in detail later so an to be discharged onto a sheet discharge tray 11 after fixation of the toner image and drying by the fixing apparatus.

Figure 3:
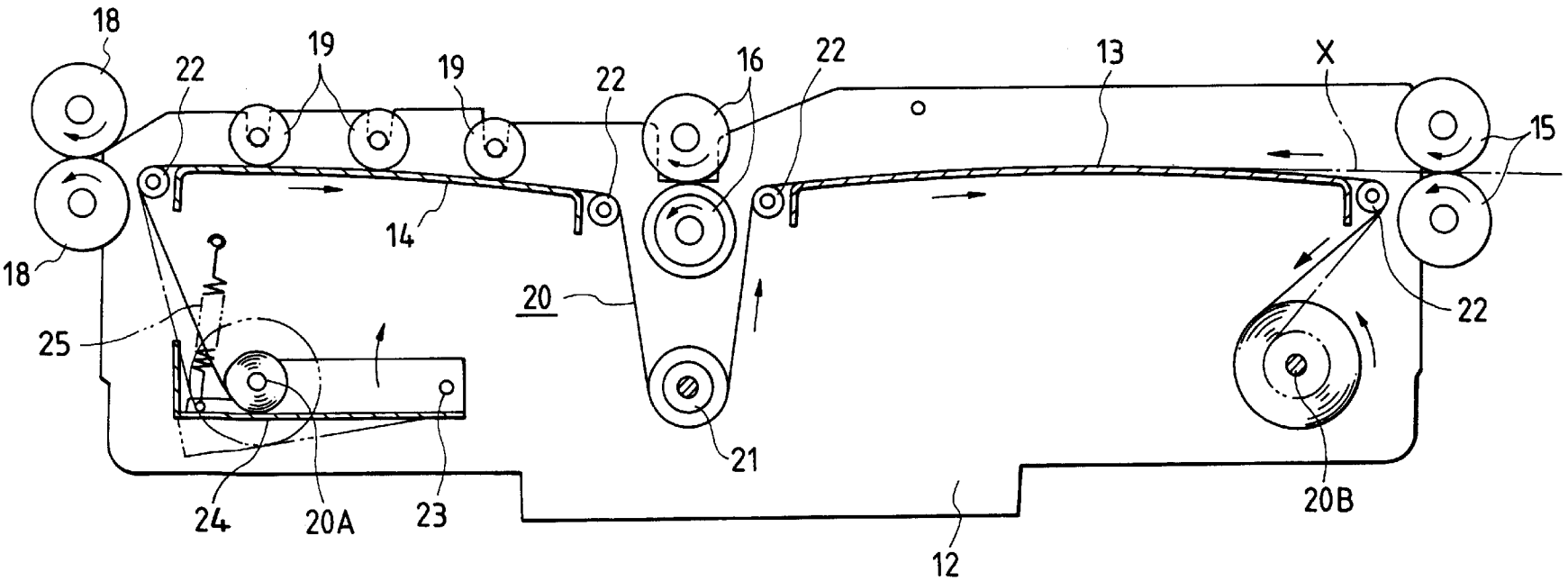
FIG. 3 is a sectional view for the fixing apparatus according to a first embodiment of the present invention.

FIG. 3 shows the fixing apparatus according to the first embodiment of the present invention, and in this fixing apparatus, a fixing apparatus frame 12 supports a preheating panel heater 13 and a drying panel heater 14 which adjoin each other in a conveyance direction of the master X. Although not shown in the figure, the preheating panel heater 13 and the drying panel heater 14 are provided respectively with electric heaters, and the electric heaters heat the preheating panel heater 13 and the drying panel heater 14.

The aforenamed fixing apparatus frame 12 also supports inlet conveyance rollers 15 which bring in the master X, intermediate conveyance rollers 16 which relay the same master X from the preheating panel heater 13 to the drying panel heater 14 and outlet conveyance rollers 18 which bring out the dried master X toward the sheet discharge tray 11, and the master X is conveyed in directions of arrows by the inlet conveyance rollers 15, the intermediate conveyance rollers 16 and the outlet conveyance rollers 18. A plurality of retaining rollers 19 are disposed on a top surface of the aforenamed drying panel heater 14, and these retaining rollers 19 have the rear surface of the master X be in tight contact with the top surface of the drying panel heater 14, in the same way as the conventional one.

According to the present invention, the top surfaces of the aforenamed preheating panel heater 13 and drying panel heater 14 are covered with a cleaning web 20 which is intermittently fed in a direction opposite to the master X. The cleaning web 20 which has approximately the same width as the preheating panel heater 13 and the drying panel heater 14 is made of extremely-thin, heat-resistant unwoven cloth, such as of a mixture of aramid and polyester or of glass wool fibers, and pulled out of a web delivery bobbin 20A which is disposed under the aforenamed drying panel heater 14 and on the outlet side thereof.

The cleaning web 20 which has been pulled out of the web delivery bobbin 20A is stretched along the top surface of the drying panel heater 14 and, after being relayed by a relay roller 21 which is disposed under the intermediate conveyance rollers 16 and then spread over the top surface of the preheating panel heater 13, wound around a web take-up bobbin 20B under the preheating panel heater 13 and on the inlet side thereof.

The tightness effect of the contact between the cleaning web 20 and a curved surface of the preheating panel heater 13 and on the inlet side thereof can be optimized simply by fine adjustment of parallelism of two pairs of guide rollers 22 which are disposed on both sides of the preheating panel heater 13 and the drying panel heater 14, and thus the broad cleaning web can be maintained in a tense state without generating wrinkles.

A brake shoe which is supported at a base part thereof by a fulcrum shaft 23 on the fixing apparatus frame 12 is provided so as to face the aforenamed web delivery bobbin 20A and, since a free end of a force-applying spring 25 is hooked on the brake shoe at a part thereof close to the end part, the force of the force-applying spring 25 presses an intermediate part of the brake shoe so as to contact with the cleaning web 20 which is wound around the web delivery bobbin 20A, so that the brake shoe 24 prevents slacking at the web delivery bobbin.

Figure 4:
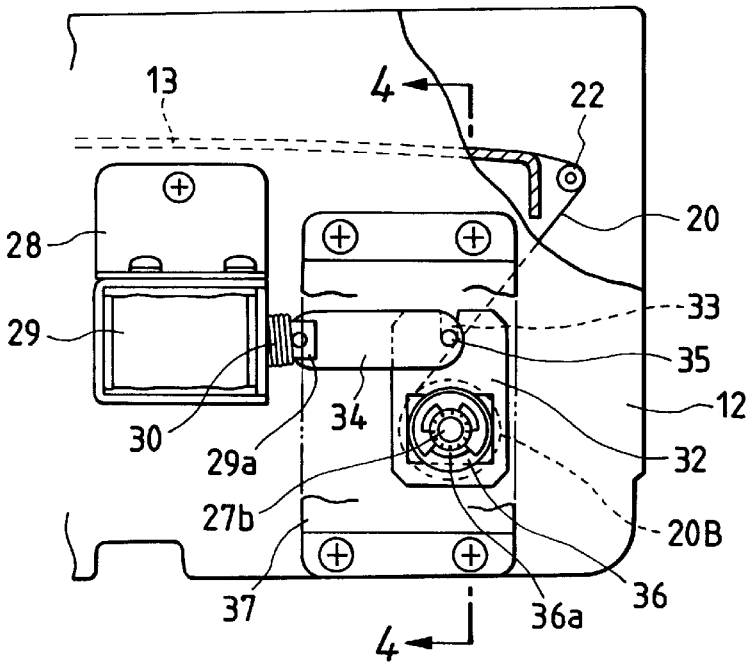
FIG. 4 is a magnified front view of principal parts of the same fixing apparatus with a partial cutout.
Figure 5:
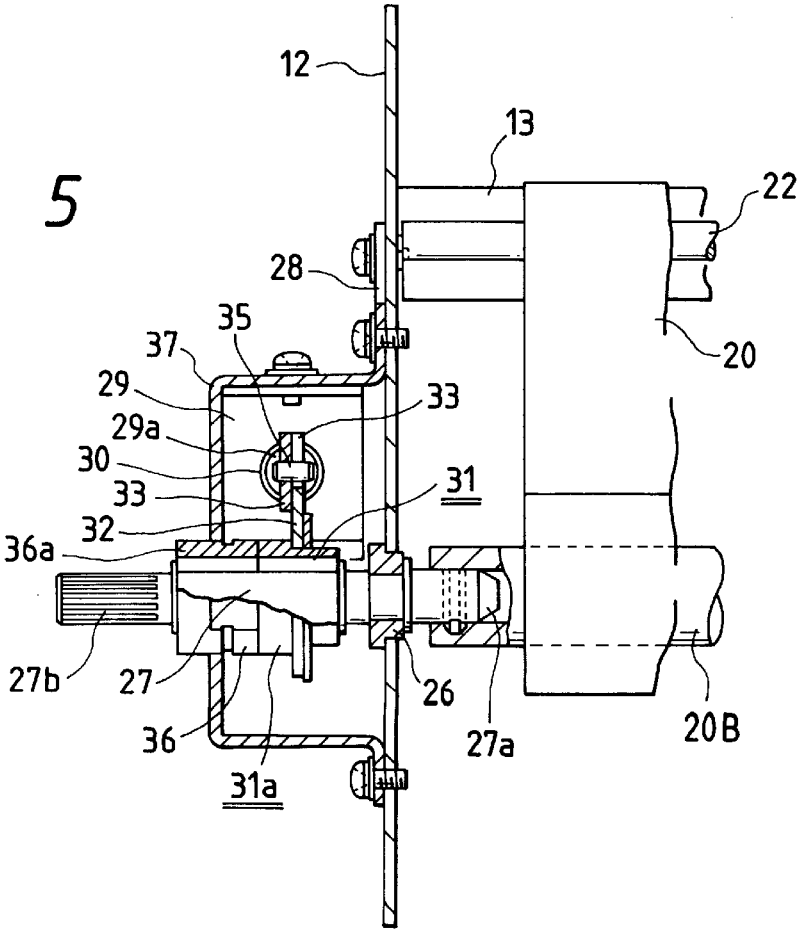
FIG. 5 is a magnified sectional view along line 4—4 in FIG. 4.

FIGS. 4 and 5 show a driver section of the web take-up bobbin 20B described above, and the driver section comprises a take-up shaft 27 which is in a state of penetration through a bearing 26 of the fixing apparatus frame 12 and can be revolved freely. At a bobbin attachment end 27*a* of the same take-up shaft 27 which is disposed inside the aforenamed fixing apparatus frame 12 supports the web take-up bobbin 20B which takes up the cleaning web 20 and, a manual operation end 27*b* of the same take-up shaft 27 which is in a state of protrusion to the outside of the fixing apparatus frame 12 may be pinched to force the take-up shaft 27 to revolve when a now cleaning web 20 is mounted.

A solenoid 29 which can be excited by electric signals is fastened to the outer surface of the aforenamed fixing apparatus frame 12 by a immovable bracket 28 and a plunger 29*a* of the solenoid 29 is applied with a force in a return direction by a pressure spring 30. As shown in FIG. 5, a first one way clutch 31 which can transmit only a counter-clockwise revolving movement of a clutch sleeve 31*a* in FIG. 4 to the take-up shaft 27 is supported at an intermediate part of the aforenamed take-up shaft 27, and a revolving member 32 is fastened to the same clutch sleeve 31*a* of the first one way clutch 31, with a connection groove 33 of the revolving member 32 being engaged with a driving pin 35 of a connecting member 34 that makes a pin joint at a tip of the aforenamed plunger 29*a*.

Therefore, when the solenoid 29 is excited to drive the plunger 29*a* to the left in FIG. 3 against the force of the pressure spring 30, the revolving member 32 and the clutch sleeve 31*a* are revolved counter-clockwise for uniform degrees of angle each time with the take-up shaft 27 as the center thereof via the connecting member 34, and thus the revolving movement of the revolving member 32 is transmitted to the take-up shaft 27 via the first one way clutch 31.

A second one way clutch 36 that adjoins the first one way clutch 31 is attached to the intermediate part of the aforenamed take-up shaft 27 and a clutch sleeve 36*a* of the same second one way clutch 36 that allows forced revolutions only in a counter-clockwise direction in FIG. 3 of the take-up shaft 27 is fastened to the attachment bracket 37 on the outer surface of the aforenamed fixing apparatus frame 12.

Consequently, since the presence of the second one way clutch 36 enables to force the take-up shaft 27 to be revolved by pinching the manual operation end 27*b* of the take-up shaft 27, irrelevant to the first one way clutch 31 and the solenoid 29, the web take-up bobbin 20B can be forced to be revolved counter-clockwise via the take-up shaft 27. As the result, when mounting a new cleaning web 20 onto the fixing apparatus, a slack in the cleaning web 20 can be eliminated promptly to render the cleaning web 20 in a tense state against the preheating panel heater 13 and the drying panel heater 14.

The fixing apparatus of the wet-type plate making machine as the first embodiment has the structure as described above, wherein, since intermittent excitations of the solenoid 29 feed the cleaning web 20 intermittently in a direction opposite to the moving direction of the master X, a contaminated part of the cleaning web 20 is wound around the web take-up bobbin 20B and the cleaning web 20 over the top surfaces of the preheating panel heater 13 and the drying panel heater 14 is maintained to be always now.

When a consumed cleaning web 20 is replaced with a new one, the cleaning web 20 which has been unwound off the web delivery bobbin 20A may be fully wound around the web take-up bobbin 20B that is supported on the take-up shaft 27 via the drying panel heater 14, the relay roller 21 and the preheating panel heater 13, and any slack in the cleaning web 20 at the time of replacement can be removed promptly without difficulty. If, after the cleaning web 20 is stretched between the web delivery bobbin 20A and the web take-up bobbin 20B, the manual operation and 27*b* of the take-up shaft 27 is forced to revolve counter-clockwise with the manual operation end 27*b* of the take-up shaft 27 between finger tips, the cleaning web 20 is wound around the web take-up bobbin 20B by itself and mounted readily in a tense state over the top surfaces of the preheating panel heater 13 and the drying panel heater 14. That is, if the cleaning web 20 is stretched easily between the web delivery bobbin 20A and the web take-up bobbin 20B, a front end of the master may be caught by saggy wrinkles of the cleaning web 20 to result with a jam but, since a forced revolution of the take-up shaft 27 by the manual operation end 27*b* can maintain the cleaning web 20 readily in a tense state, the cleaning web can be replaced even by a user without difficulty.

Figure 6:
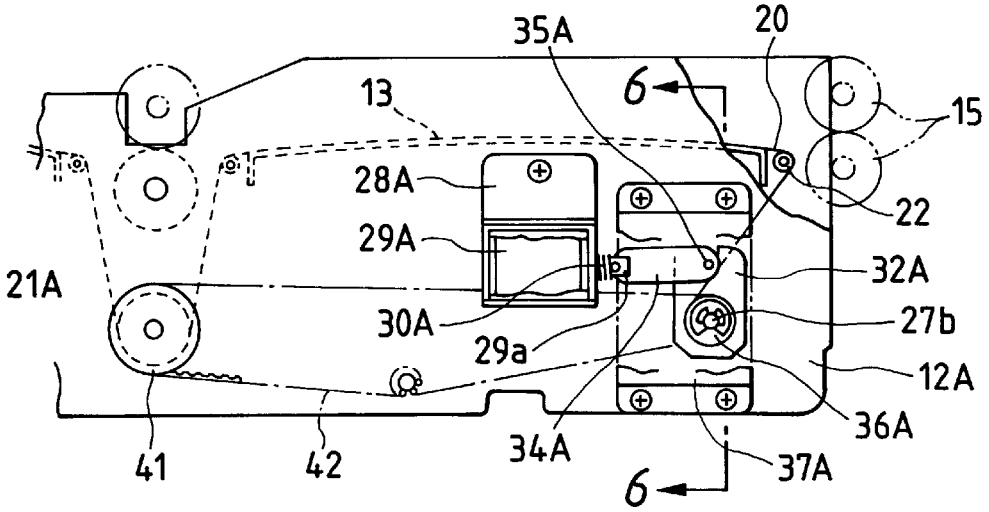
FIG. 6 is a magnified front view showing principal parts of a fixing apparatus according to a second embodiment of the present invention.
Figure 7:
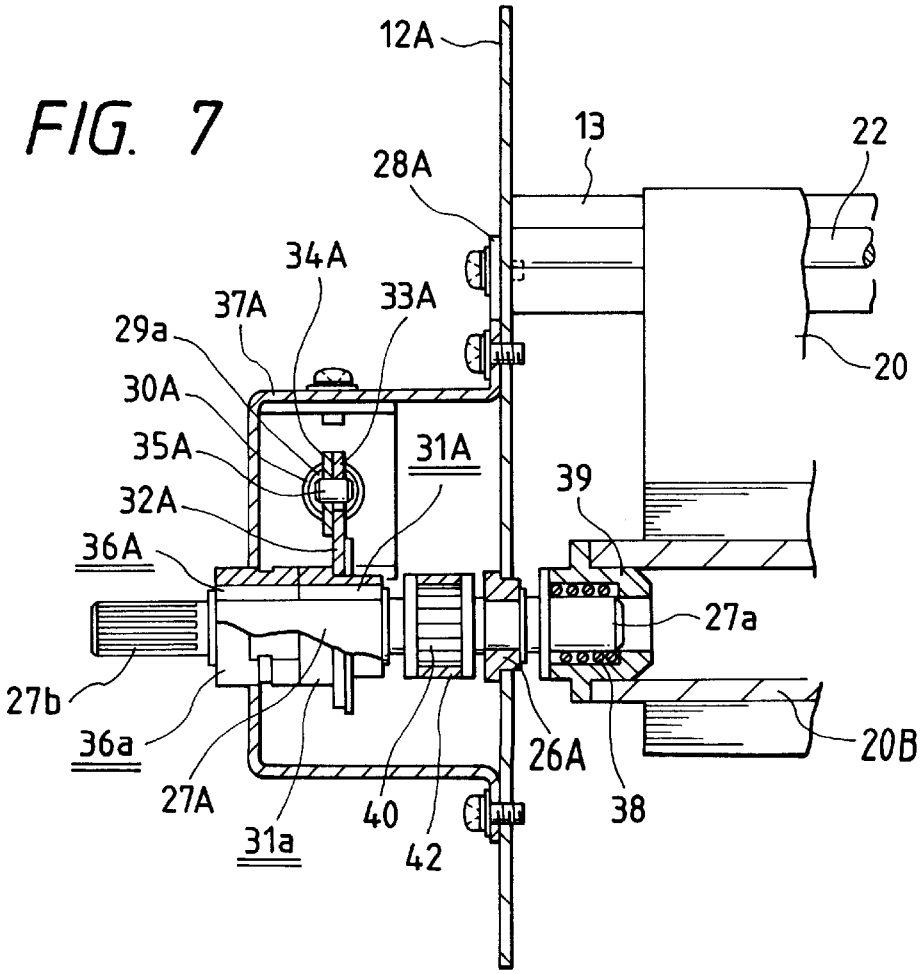
FIG. 7 is a magnified sectional view showing a fixing apparatus along line 6—6 in FIG. 6.

FIGS. 6 and 7 show a fixing apparatus for a wet-type plate making machine according to a second embodiment of the present invention, which is characterized by that intermittent feeding of a uniform length of cleaning web 20 each time can be realized consistently by periodical excitations of the solenoid 29A, irrelevant to the changing diameter of the web take-up bobbin 20B.

A driver section shown in FIGS. 6 and 7 includes a take-up shaft 27A which is in a state of penetration through a bearing 26A of a fixing apparatus frame 12A and can be revolved freely in the same way as the first embodiment.

In the second embodiment, however, a cylinder-shaped bobbin holder 39 is supported at a bobbin attachment end 27*a* of the same take-up shaft 27A which is disposed inside the aforenamed fixing apparatus frame 12A via a torque limiter 38, and the web take-up bobbin 20B which takes up the cleaning web 20 is supported by this bobbin holder 39.

In the same way as the first embodiment, a manual operation end 27*b* of the same take-up shaft 27A which is in a state of protrusion to the outside of the fixing apparatus frame 12A may be pinched to force the take-up shaft 27A to revolve.

The fixing apparatus for the wet-type plate making machine as the second embodiment is now discussed in detail, wherein a solenoid 29A which can be excited by electric signals is fastened to the outer surface of the aforenamed fixing apparatus frame 12A by an immovable bracket 28A and a plunger 29*a* of the solenoid 29A is applied with a force in a return direction by a pressure spring 30A.

As shown in FIG. 7, a first one way clutch 31A which can transmit only a counter-clockwise revolving movement of a clutch sleeve 31*a* in FIG. 6 to the take-up shaft 27A is supported at an intermediate part of the aforenamed take-up shaft 27A, and a revolving member 32A is fastened to the same clutch sleeve 31*a* of the first one way clutch 31A, with a connection groove 33A of the revolving member 32A being engaged with a driving pin 35A of a connecting member 34 that makes a pin joint at a tip of the aforenamed plunger 29*a*. Therefore, when the solenoid 29A is excited to drive the plunger 29*a* to the left in FIG. 6 against the force of the pressure spring 30A, the revolving member 32A and the clutch sleeve 31*a* are revolved counter-clockwise for uniform degrees of angle each time with the take-up shaft 27A as the center thereof via the connecting member 34A, and thus the revolving movement of the revolving member 32A is transmitted to the take-up shaft 27A via the first one way clutch 31A but revolving forces of the take-up shaft 27A, which is larger than a certain torque, will not be transmitted to the web take-up bobbin 20B since the torque limiter 38 is mounted between the same take-up shaft 27A and the bobbin holder 39.

A second one way clutch 36A that adjoins the first one way clutch 31A is attached to the intermediate part of the aforenamed take-up shaft 27A and a clutch sleeve 36*a* of the same second one way clutch 36A that allows forced revolutions only in a counter-clockwise direction in FIG. 6 of the take-up shaft 27A is fastened to the attachment bracket 37 on the outer surface of the aforenamed fixing apparatus frame 12A; therefore, since the presence of the second one way clutch 36A enables to force the take-up shaft 27A to be revolved by pinching the manual operation end 27*b* of the take-up shaft 27A, irrelevant to the first one way clutch 31A and the solenoid 29A, the web take-up bobbin 20B can be forced to be revolved counter-clockwise via the take-up shaft 27A; consequently, when mounting a new cleaning web 20 onto the fixing apparatus, a slack in the cleaning web 20 can be eliminated promptly to render the cleaning web 20 in a tense state against the preheating panel heater 13 and the drying panel heater 14.

On the other hand, in order to feed the cleaning web intermittently at a uniform pitch, a driving sprocket 40 of a small diameter is fastened to the intermediate part of the aforenamed take-up shaft 27A while a driven sprocket 41 of a large diameter is fastened to a core shaft of a relay roller 21A, and the relay roller 21A is intermittently fed counter-clockwise in FIG. 6 at a reduced speed by a timing belt 42 that is stretched to connect between the driving sprocket 40 and the driven sprocket 41.

The fixing apparatus for the wet-type plate making machine according to the second embodiment has the structure as described above and thus, when a consumed cleaning web 20 is replaced with a new one, the cleaning web 20 which has been unwound off the web delivery bobbin 20A may be fully wound around the web take-up bobbin 20B that is supported on the take-up shaft 27A via the drying panel heater 14, the relay roller 21 and the preheating panel heater 13 and, in this case, after the cleaning web 20 is stretched between the web delivery bobbin 20A and the web take-up bobbin 20B, if the manual operation and 27*b* of the take-up shaft 27A is forced to revolve counter-clockwise with the manual operation end 27*b* of the take-up shaft 27A between finger tips, the cleaning web 20 is wound around the web take-up bobbin 20B by itself and mounted readily in a tense state over the top surfaces of the preheating panel heater 13 and the drying panel heater 14.

If the solenoid 29 is excited intermittently while the fixing apparatus of the wet-type plate making machine is being operated, the movement of the plunger 29*a* of the solenoid 29A is transmitted to the bobbin holder 39 and the driver sprocket 40 via the first one way clutch 31A, but the counter-clockwise revolving movements of the driver sprocket 40 is transmitted to the relay roller 21A via the timing belt 42 and the driven sprocket 41 so that the decelerated revolving movement of the relay roller 21A feeds a uniform length of the cleaning web 20 each time in a direction of the web take-up bobbin 20B.

At the same time as this, the web take-up bobbin 20B is also revolved counter-clockwise intermittently by the bobbin holder 39 which is transmitted with the intermittent revolving movements of the take-up shaft 27A but, since the torque limiter 38 which prevents transmission of torques larger than a certain torque exists between the bobbin attachment end 27*a* of the take-up shaft 27 and the bobbin holder 39, a sliding movement inside the same torque limiter 38 allows the web take-up bobbin 20B to take up the cleaning web 20 as much as the intermittent feeding by the relay roller 21A.

Consequently, the fixing apparatus of the we-type plate making machine as the second embodiment wherein the cleaning web 20 can be progressed intermittently at the uniform pitch, irrelevant to the taken-up web diameter of the web take-up bobbin 20B realizes a uniform feeding of the cleaning web to the preheating panel heater 13 and the drying panel heater 14 without being influenced by changes in the diameters of the web delivery bobbin 20A and he web take-up bobbin 20B so that contamination on the cleaning web can be controlled fully.

The above first and second embodiments are excellent in that an inexperienced operator can Bet a new cleaning web in a tense state without slacking. However, the present invention is not limited by or to the above embodiments.

Subsequently, other embodiments of the present invention will be described with reference to FIGS. 8 and 9.

Figure 8:
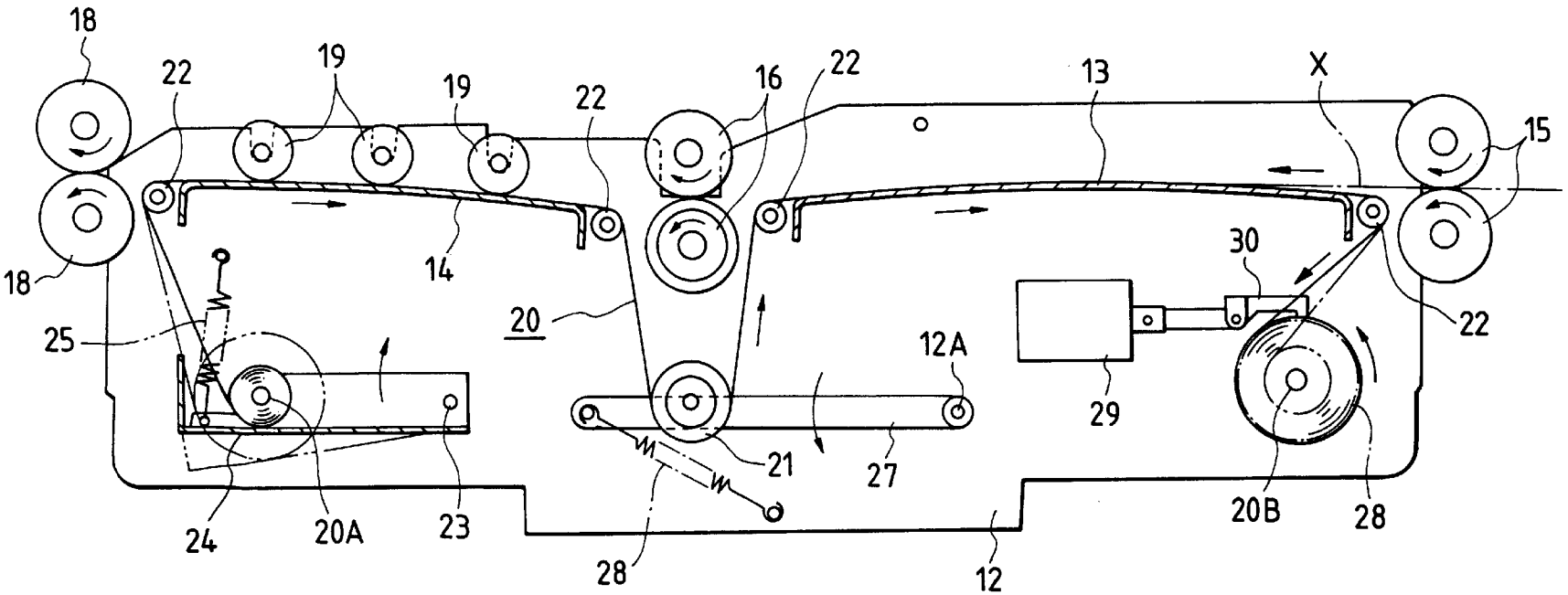
FIG. 8 is a sectional view of the fixing apparatus in accordance with a third embodiment of the present invention.

FIG. 8 shows a wet-type plate making machine according to a third embodiment of the present invention. In this fixing apparatus, a fixing apparatus frame 12 supports a preheating panel heater 13 and a drying panel heater 14 which adjoin each other in a conveyance direction of the master X. Although not shown in the figure, the preheating panel heater 13 and the drying panel heater 14 are provided respectively with electric heaters, and the electric heaters heat the preheating panel heater 13 and the drying panel heater 14.

The aforenamed fixing apparatus frame 12 also supports inlet conveyance rollers 15 which bring in the master X, intermediate conveyance rollers 16 which relay the same master X from the preheating panel heater 13 to the drying panel heater 14 and outlet conveyance rollers 18 which bring out the dried master X toward the sheet discharge tray 11, and the master X is conveyed in directions of arrows by the inlet conveyance rollers 15, intermediate conveyance rollers 16 and outlet conveyance rollers 18. A plurality of retaining rollers 19 are disposed on a top surface of the aforenamed drying panel heater 14, and these retaining rollers 19 have the rear surface of the master X be in tight contact with the top surface of the drying panel heater 14, in the same way as the conventional one.

According to the present invention, the top surfaces of the aforenamed preheating panel heater 13 and drying panel heater 14 are covered with a cleaning web 20 which is intermittently fed in a direction opposite to the master X. The cleaning web 20 which has approximately the same width as the preheating panel heater 13 and the drying panel heater 14 is made of extremely-thin, heat-resistant unwoven cloth, such as of a mixture of aramid and polyester or of glass wool fibers, and pulled out of a web delivery bobbin 20A which is disposed under the aforenamed drying panel heater 14 and on the outlet side thereof.

The cleaning web 20 which has been pulled out of the web delivery bobbin 20A is stretched along the top surface of the drying panel heater 14 and, after being relayed by a tension roller 21 which is disposed under intermediate rollers 16 and then spread over the top surface of the preheating panel heater 13, wound around a web take-up bobbin 20B under the preheating panel heater 13 and on the inlet side thereof.

The tightness effect of the contact between the cleaning web 20 and a curved surface of the preheating panel heater 13 and on the inlet side thereof can be optimized simply by fine adjustment of parallelism of two pairs of guide rollers 22 which are disposed on both sides of the preheating panel heater 13 and the drying panel heater 14, and thus the broad cleaning web can be maintained in a tense state without generating wrinkles.

A brake shoe which is supported at a bass part thereof by a fulcrum shaft 23 on the fixing apparatus frame 12 is provided so as to face the aforenamed web delivery bobbin 20A and, since a free end of a force-applying spring 25 is hooked on the brake shoe at a part thereof close to the end part, the force of the force-applying spring 25 presses an intermediate part of the brake shoo so as to contact with the cleaning web 20 which is wound around the web delivery bobbin 20A, so that the brake shoe 24 prevents slacking at the web delivery bobbin. The aforenamed tension roller 21 is supported at an intermediate part of a tension arm 27 which is supported on the fixing apparatus frame 12 by a core shaft 12A and, since the tension arm 27 is applied with a counter-clockwise force, with the core shaft 12A' as the center thereof, by a tension spring 28 which is hooked to the and of the tension arm 27, the tense state of the cleaning web 20 is maintained by the tension roller 21.

The aforenamed web take-up bobbin 20B can be rotated counter-clockwise together with a ratchet wheel 28 as a single unit and for the purpose of an intermittent progressive drive of the web take-up bobbin 20B, the ratchet wheel 28 confronts a ratchet pawl 30 which is operated at regular intervals by a solenoid 29.

The fixing apparatus for the wet-type plate making machine according to the third embodiment has the structure as described above, wherein the master X has been conveyed to the fixing apparatus by revolving movements of the inlet conveyance rollers 15 and then dried preliminarily through heating by the preheating panel heater 13. In this case of preheating, the cleaning web 20 which is laid over the top surface of the preheating panel heater 13 adsorbs the drops of liquid on the rear surface of the master X and prevents solidification on the rear surface.

In the same way, since the toner and such on the rear surface of the master which has been conveyed to the drying panel heater 14 are transferred to a part of the cleaning web 20 which is situated an the top surface of the drying panel heater 14, the master X after fixation of the toner image is brought out in a normal state onto the sheet discharge tray 17.

When the cleaning web 20 which adsorbs foreign matters, such as surplus toner, is intermittently fed by the ratchet pawl 30 to be gradually wound around the web take-up bobbin 20B, a clean part of the cleaning web 20 is always situated on the top surfaces of the preheating panel heater 13 and the drying panel heater 14 and, since the cleaning web 20 is intermittently fed in the direction opposite to the conveyance direction of the master X, a contaminated part is sequentially wound around the web take-up bobbin 20B, a new part of the cleaning web 20 is always supplied to the drying panel heater 14 which is required to be in a normal state.

Consequently, in the fixing apparatus of the wet-type plate making machine in accordance with the first embodiment, elimination of deposition of foreign matters, such as toner, on the top surfaces of the preheating panel heater 13 and the drying panel heater 14 can successfully prevent the master from jamming, which has been caused by the foreign matter, to realize fixing treatment of the master which has been maintained in the normal state.

Figure 9:
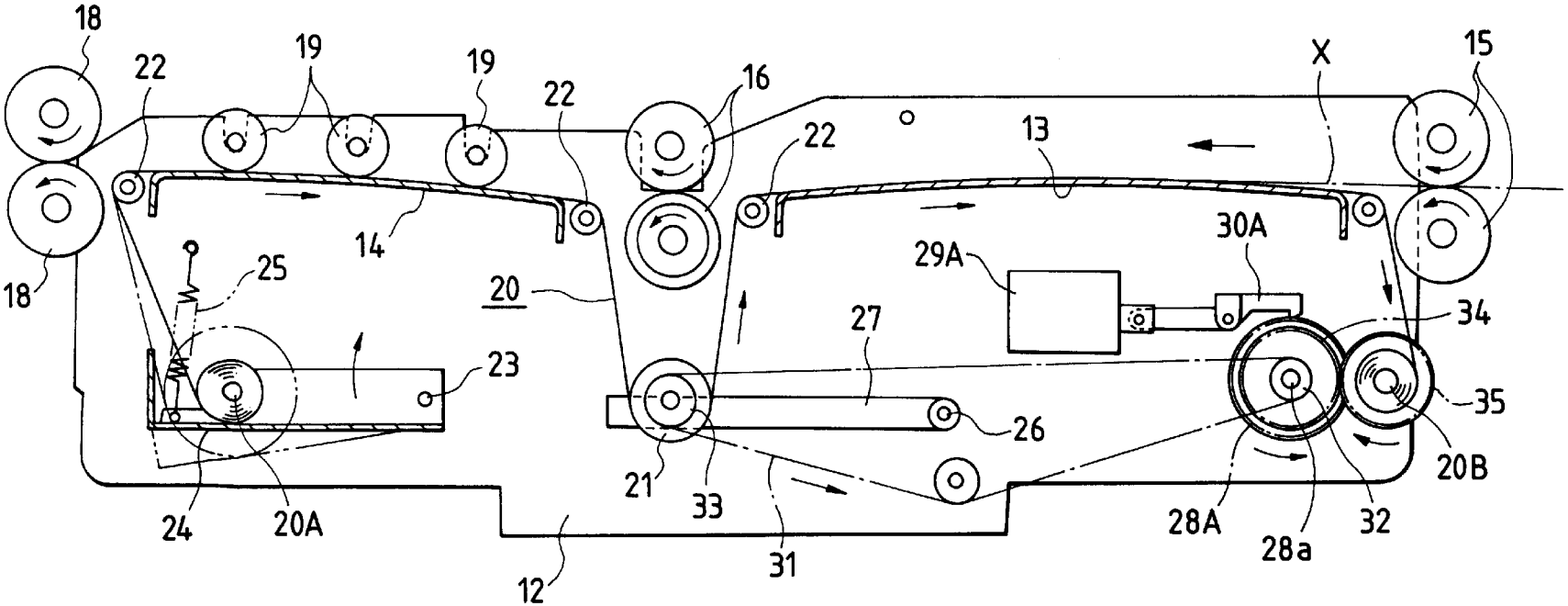
FIG. 9 is a sectional view of the fixing apparatus according to a third embodiment of the present invention, which corresponds to FIG. 8.

FIG. 9 shows a fixing apparatus for a wet-type plate making machine according to a fourth embodiment of the present invention, wherein a tension roller 21 is revolved periodically for uniform degrees of angle each time via a ratchet wheel 28A and a timing belt 31.

In this embodiment, a fixing apparatus frame 12, a preheating panel heater 13, a dryer-side panel heater 14, inlet conveyance rollers 15, inter mediate conveyance rollers 16, outlet conveyance rollers 18, a fixing apparatus frame 12, a web delivery bobbin 20A, a web take-up bobbin 20B, guide rollers 22, a brake shoe 24 and a force-applying spring 25 have completely the same constitutions as the first embodiment, whereas a ratchet pawl 30A which is driven by a solenoid 29A intermittently progresses the ratchet wheel 28A counter-clockwise at regular intervals for uniform degrees of angle each time.

A driving sprocket 32 is fastened to a driving shaft 28*a* of the ratchet wheel 28A and the timing belt 31 is stretched between a driven sprocket 33, which is incorporated with the tension roller 21A, and the same driving sprocket 32, wherein a tension arm 27 in applied with a counter-clockwise force with a core shaft 26 as the center thereof by the same timing belt 31.

The aforenamed driving shaft 28*a* is disposed with a take-up gear 34 via a one-way clutch which is not shown in the figure, and the take-up gear 34 is engaged with a driven gear 35 which can be revolved together with the aforenamed web take-up bobbin as a single unit.

The fixing apparatus for the wet-type plate making machine in accordance with the fourth embodiment has the structure as described above, wherein, if the ratchet pawl 30A is operated by periodic excitations of the solenoid 29A, the tension roller 21 is revolved for uniform degrees of angle each time via the ratchet wheel 28A, the driving sprocket 32, the timing belt 31 and the driven sprocket 33, and, simultaneously, a tensile force is applied counter-clockwise from the timing belt 31 to the tension arm 27.

The revolving movement of the ratchet wheel 28A is transmitted to the take-up gear 34 and, with a revolving force which is given to the web take-up bobbin 20B in the clockwise direction, the cleaning web 20 is wound around the web take-up bobbin 20B.

Since the structure of the fourth embodiment realizes a intermittent feeding of uniform amount of the cleaning web 20, irrelevant to the taken-up web diameter, a stable cleaning affect can be expected in the cleaning web 20.

In the above-described embodiments, the preheating panel heater and the drying panel heater are provided separately. However, those preheating panel heater and the drying panel heater may be integrated into one panel heater for preheating and drying. With this arrangement, the structure can be simplified with the results that the number of parts is decreased, and the costs are reduced. Since the overall length of the panel heater is shortened, the fixation is lowered. However, the fixation can be ensured with the arrangement that the conveying speed is decreased (a fixing period of time is elongated), and a plurality of retaining rollers are arranged on the surface of the panel heater.

Figure 10A:
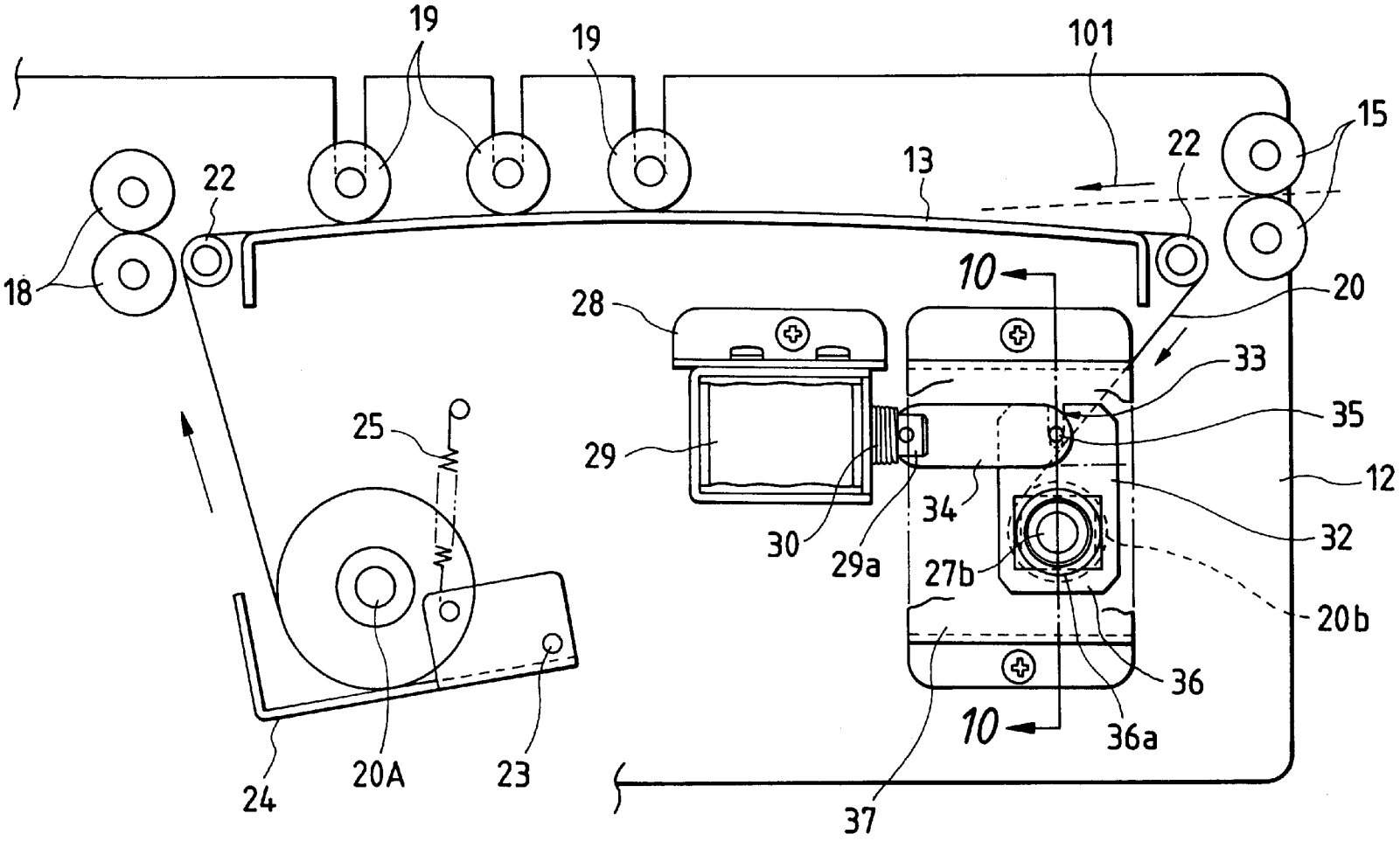
FIG. 10A is a sectional view for the fixing apparatus according to another embodiment of the present invention.
Figure 10B:
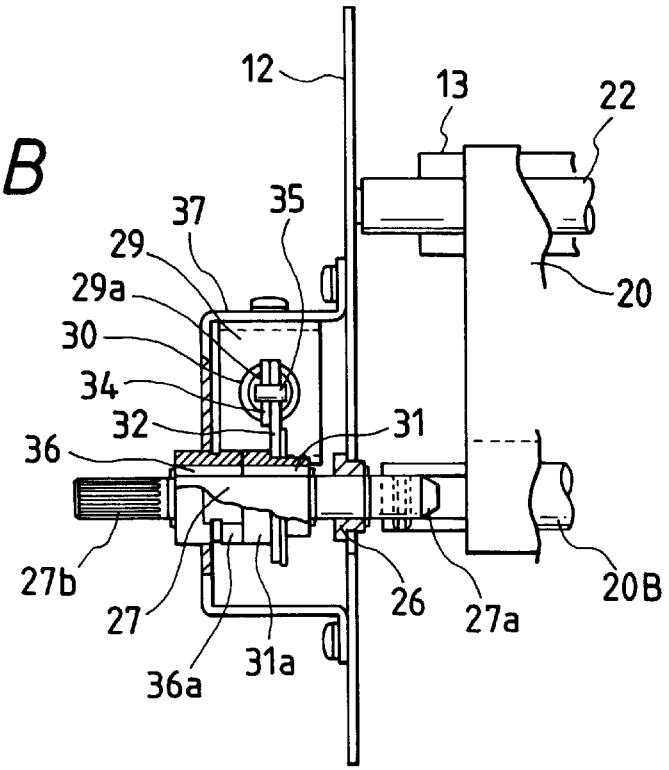
FIG. 10B is a magnified sectional view taken along line 10—10 of FIG. 10A.
Figure 11B:
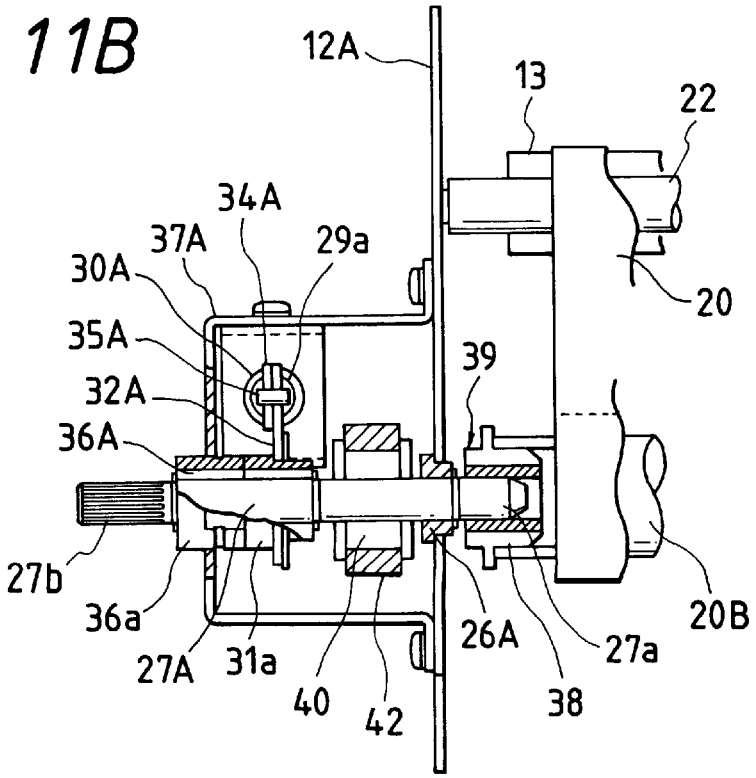
FIG. 11B is a magnified sectional view taken along line 11—11 of FIG. 11A.
Figure 11A:
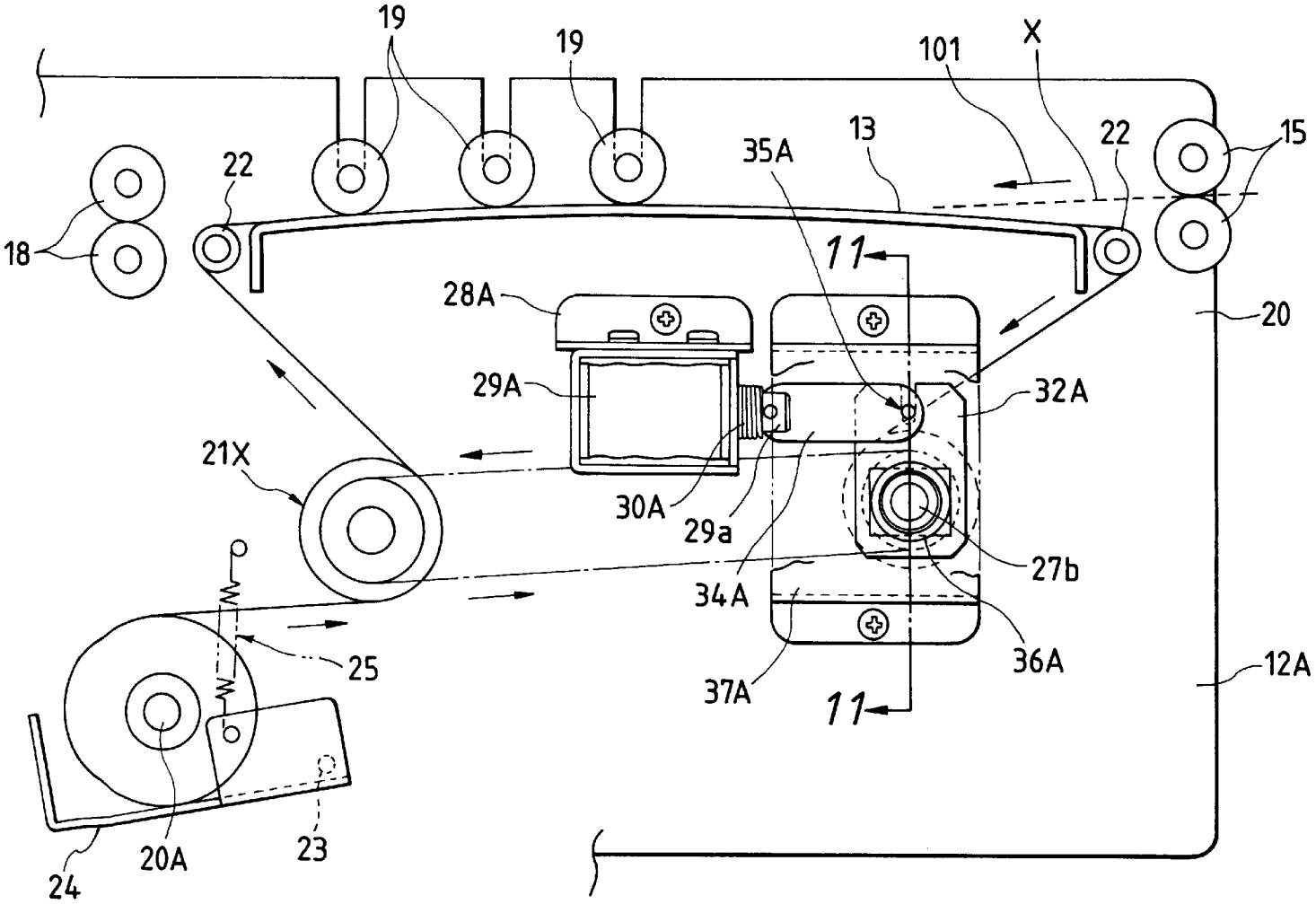
FIG. 11A is a sectional view for the fixing apparatus according to still another embodiment of the present invention.

FIGS. 10A, 10B and 11A, 11B show examples of a fixing apparatus using the integrated panel heater, respectively. FIGS. 10A and 10B show the fixing apparatus in which a cleaning web is taken up at a constant angular velocity. FIGS. 11A and 11B show the fixing apparatus in which a cleaning web is taken up at a constant amount velocity.

In FIGS. 10A and 11A, a left side (where retaining rollers 19 are disposed) of the panel heater serves as a drying heater and a right side thereof (where no retaining rollers 19 are disposed) serves as a preheating heater. Also, in FIGS. 10A and 11A, a master paper is conveyed from the right side toward the left side as indicated by an arrow 101 as in the above-described embodiments. In FIGS. 11A and 11B, an intermediate roller 21X functions in the same manner as that of the tension roller 21 in FIG. 3 for conveying the cleaning web at a constant amount velocity.

As was described in the above, according to the present invention, the top surfaces of the panel heaters are always maintained in the normal state by the cleaning web which is intermittently fed in the direction opposite to that of the master can prevent such troubles as the jamming of the master by foreign matters that have stuck to the top surfaces of the panel heaters and the contamination of hands and other parts by the master which has been contaminated by the foreign materials Also, according to the present invention, the manual operation of the take-up shaft can remove slacking in the cleaning web readily and promptly when the cleaning web is replaced or mounted.

Further, according to the present invention, the cleaning web can be fed intermittently at the uniform pitch with intermittent excitations of the solenoid, irrelevant to the changes in the diameters of the web delivery bobbin and the web take-up bobbin.

What is claimed is:

1. A fixing apparatus for a wet-type plate making machining, comprising:

at least one panel heater;

a cleaning web put on said panel heater;

a delivery bobbin for delivering said cleaning web;

a take-up bobbin for taking up said cleaning web; and wherein said cleaning web is intermittently fed in a direction opposite to a conveyance direction of a master to adsorb a surplus solution on a rear surface of the master.

2. A fixing apparatus according to claim 1, wherein said panel heater comprises a preheating panel heater and a drying heater.

3. A fixing apparatus according to claim 1, further comprising a ratchet and a sliding mechanism for giving a take-up force to said take-up bobbin.

4. A fixing apparatus according to claim 1, further comprising a first one-way clutch for giving a take-up force to said take-up bobbin.

5. A fixing apparatus according to claim 1, further comprising a first one-way clutch and a sliding mechanism for giving a take-up force to said take-up bobbin.

6. A fixing apparatus according to claim 4 or 5, further comprising a manual operation end using a second one-way clutch disposed on a take-up shaft.

7. A fixing apparatus according to claim 1, wherein said panel heater comprises a preheating and drying panel heater.

* * * * *